US005103501A

United States Patent [19]

Meisels

[11] Patent Number: 5,103,501

[45] Date of Patent: Apr. 14, 1992

[54] TRAVELING AND DISPOSABLE UNDERWEAR

[76] Inventor: Chaskel Meisels, 1415 46th St., Brooklyn, N.Y. 11219

[21] Appl. No.: 595,991

[22] Filed: Oct. 11, 1990

[51] Int. Cl.[5] ..... A41B 9/00; A41D 1/20

[52] U.S. Cl. ..... 2/113; 2/53; 2/70; 2/104; 2/400; 2/405; 2/408

[58] Field of Search ..... 2/46, 54, 113, 114, 2/400, 401, 78 B, DIG. 6, 78 R, 104, 405, 408, 70, 53; 224/183

[56] References Cited

U.S. PATENT DOCUMENTS

| | | | |
|---|---|---|---|
| 24,033 | 5/1859 | Lesher | 2/54 |
| 1,477,218 | 12/1923 | Guinzburg | 2/54 |
| 1,489,046 | 4/1924 | Thompson | 2/114 |
| 1,750,084 | 3/1930 | Abrahamson | 2/113 |
| 2,598,759 | 6/1952 | Calde | 2/107 |
| 3,276,036 | 10/1966 | Cater | 2/114 |
| 3,418,659 | 12/1968 | Brown | 2/111 |
| 3,611,439 | 10/1971 | Meyers | 2/54 |
| 3,885,383 | 5/1975 | Tanaka | 224/183 |
| 4,004,294 | 1/1977 | Pinch | 2/104 |
| 4,100,621 | 7/1978 | Ettipio | 2/114 |
| 4,249,267 | 2/1981 | Voss | 2/69 |
| 4,446,575 | 5/1984 | Davis | 2/408 |
| 4,597,110 | 7/1986 | Smith, Sr. et al. | 2/408 |
| 4,663,782 | 5/1987 | Knox et al. | 2/104 |
| 4,702,239 | 10/1987 | Ichikawa | 2/403 |
| 4,930,161 | 6/1990 | Cohen | 2/408 |
| 4,951,321 | 8/1990 | Mortensen et al. | 2/408 |
| 4,961,234 | 10/1990 | Leibman | 2/408 |

FOREIGN PATENT DOCUMENTS

| | | | |
|---|---|---|---|
| 220819 | 9/1957 | Australia | 2/408 |
| 467988 | 9/1950 | Canada | 2/104 |
| 208956 | 4/1909 | Fed. Rep. of Germany | 2/408 |
| 682391 | 5/1930 | France | 2/104 |
| 636684 | 5/1950 | United Kingdom | 2/408 |

*Primary Examiner*—Werner H. Schroeder
*Assistant Examiner*—Amy Brooke Vanatta

[57] ABSTRACT

Traveling and disposable underwear is provided and consists of typically three undergarments which are an undershirt, a pair of men's underpants and a pair of women's panties. The three undergarments are fabricated of an absorbent material and include elastic bands for comfortably holding the undergarments to the wearer. The three undergarments are also provided with magnetic fasteners for closing openings and securing together similarly provisioned garments which allow for easier donning and doffing without tearing the undergarments.

7 Claims, 1 Drawing Sheet

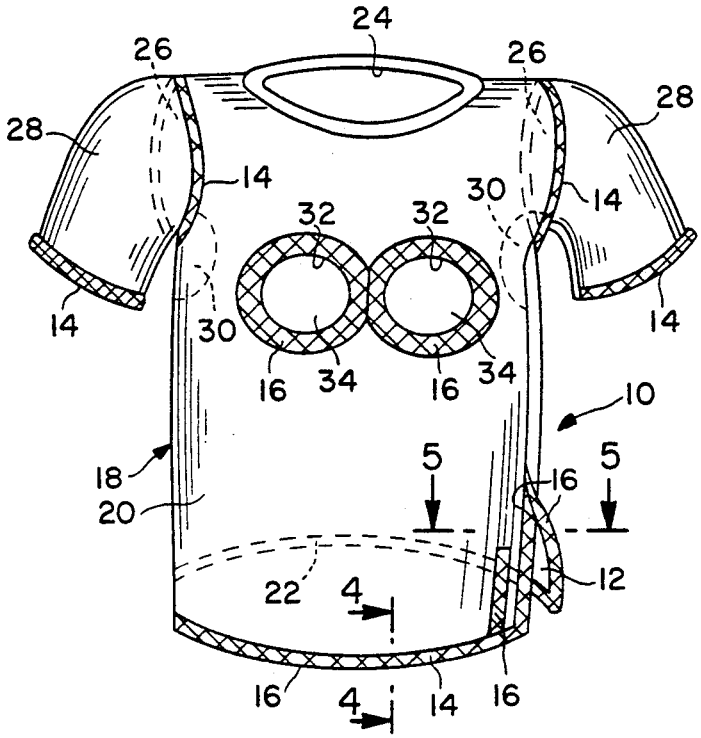
FIG. 1
FIG. 5
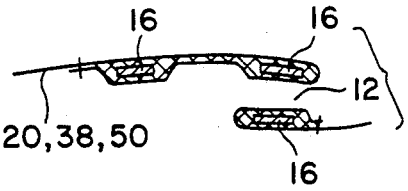
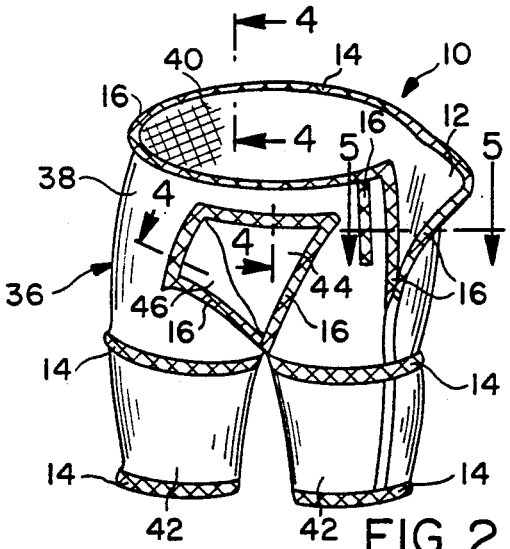
FIG. 2
FIG. 3
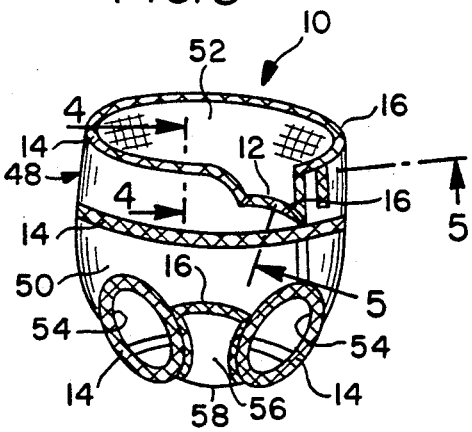
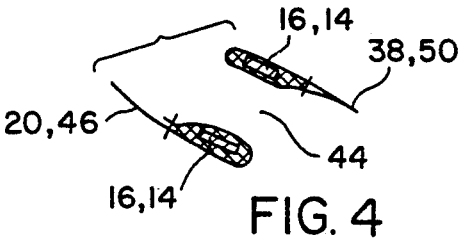
FIG. 4

TRAVELING AND DISPOSABLE UNDERWEAR

BACKGROUND OF THE INVENTION

The instant invention relates generally to disposable undergarments and more specifically it relates to traveling and disposable underwear.

Numerous articles of clothing have been provided in the prior art that are adapted to be worn and then discarded. For example, Bindler U.S. Pat. No. 3,137,860; Artzt U.S. Pat. No. 3,474,465; Benevento U.S. Pat. No. 3,636,953; Abrams et al U.S. Pat. No. 4,145,763; McGowan U.S. Pat. No. 4,258,440; Cadoret U.S. Pat. No. 4,554,684; Toth U.S. Pat. No. 4,408,357; Heran et al U.S. Pat. No. 4,641,381; Heran et al U.S. Pat. No. 4,646,362; Green U.S. Pat. No. 4,674,135 and French patents number 1.595.916 to Belpaume and 2.145,126 to Ets all are illustrative of such prior art. While these units may be suitable for the particular purpose to which they address, they would not be as suitable for the purpose of the present invention as hereafter described.

SUMMARY OF THE INVENTION

A primary object of the present invention is to provide traveling and disposable underwear that will overcome the shortcomings of the prior art devices.

Another object is to provide traveling and disposable underwear that is so fabricated, as to be comfortable and attractive when worn on a person.

An additional object is to provide traveling and disposable underwear that is so fabricated, as to contain magnetic fasteners, removable nursing pads and a removable absorbent sanitary hygienic pad.

A further object is to provide traveling and disposable underwear that is simple and easy to use.

A still further object is to provide traveling and disposable underwear that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of an undershirt with the instant invention incorporated therein;

FIG. 2 is a perspective view of men's underpants with the instant invention incorporated therein.

FIG. 3 is a perspective view of women's panties with the instant invention incorporated therein;

FIG. 4 is a diagrammatic cross sectional view taken on lines 4—4 of FIGS. 1, 2, and 3; and FIG. 5 is a diagrammatic cross sectional view taken on lines 5—5 of FIGS. 1, 2 and 3.

DETAILED DESCRIPTION OF THE PREFERRED EMBODIMENTS

Turning now descriptively to the drawings, in which like reference characters denote like elements throughout the several views, the figure illustrates the invention which is an undergarment 10 fabricated out of soft absorbent material typically paper or cloth having a side opening 12.

Elastic bands 14 are secured to the undergarment 10, allowing the undergarment to adjustably fit a wearer (not shown). Magnetic fasteners 16 are secured to the side seam opening 12 in the undergarment 10 for closure of the side seam opening, thereby enabling the wearer to easily don and doff the undergarment 10.

FIG. 1 shows the undergarment 10 as an undershirt 18 that includes a main body 20 having a waist opening 22, a neck opening 24 and a pair of sleeve openings 26. A sleeve 28 is fixedly secured about each sleeve opening 22 in the main body 20 for receiving each arm of the wearer. An elastic band 14 is fixedly secured about the bottom of each sleeve 28, about the top of each sleeve 28 at the sleeve opening 26 in the main body 20 and about the waist opening 22 in the main body 20. An absorbent pad 30 is fixedly secured in an arm pit area in each sleeve opening 26 in the main body 20 for absorbing underarm perspiration of the wearer. The magnetic fasteners 16 are fixedly secured to opposite edges of the side seam opening 12 at the waist opening 22 in the main body 20 so that after the wearer dons the undershirt 18, the magnetic fasteners 16 will provide adjustable closure of the side seam opening 12. Magnetic fasteners 16 are secured at the bottom of the waist opening 22, along the periphery thereof to act as an adjustable unit with the elastic 14 located at the waist opening 22. This allows the undershirt 18 to be fixedly secured to opposite mating edges of underpants or panties likewise provisioned with elastic and magnetic fasteners at the waist region.

The main body 20 of the undershirt 18 has a pair of breast openings 32 and a pair of nursing pads 34 to cover the breast openings 32 in the main body 20. The magnetic fasteners 16 are fixedly secured about the breast openings 32 and about the nursing pads 34 so that the nursing pads 34 are removably secured over the breast openings in the main body 20. This allows a woman who is wearing the undershirt 18 to breast feed a baby.

FIG. 2 shows the undergarment 10 as a pair of men's underpants 36 that includes a main body 38 having a waist opening 40 and a pair of legs 42. Each elastic band 14 is fixedly secured about the bottom of one leg 42, about one leg 42 below a crotch portion of the main body 38 and about the waist opening 40 in the main body 38. A first set of magnetic fasteners 16 are fixedly secured to opposite edges of the side seam opening 12 at the waist opening 40 in the main body 38 so that after the underpants are pulled upon the wearer the first set of magnetic fasteners 16 will provide adjustable closure of the side seam opening 12. A second set of magnetic fasteners 16 are fixedly secured about a fly-opening 44 and about a fly-flap 46 of the main body 38 so that the second set of magnetic fasteners 16 will provide closure for the fly-flap 46 when pressed closed. The waist opening 40 is provided with magnetic fasteners 16 about the periphery thereof to act as an adjustable unit with the elastic band 14 to allow the underpants 36 to be fixedly secured to opposite mating edges of an undershirt likewise provisioned.

FIG. 3 shows the undergarment 10 as a pair of women's panties 48 that include a main body 50 having a waist opening 52 and a pair of leg openings 54. Each elastic band 14 is fixedly secured about one leg opening 54, about an intermediate portion of the main body 50 that engages with a hip portion of the wearer and about the waist opening 52 in the main body 50. The magnetic fasteners 16 are fixedly secured to opposite edges of the side seam opening 12 at the waist opening 52 in the main body 50 so that after the panties 48 are pulled upon the wearer, the magnetic fasteners 16 will provide adjustable closure of the side seam opening 12. The waist opening 52 is also provided with magnetic fasteners 16 about the periphery thereof.

A sanitary hygienic pad 56 is for a crotch area 58 of the main body 50. Magnetic fasteners 16 are fixedly secured about the crotch area 58 of the main body 50 and the sanitary hygienic pad 56 is removably secured to the crotch area 58 of the main body 50.

It shall be noted that some absorbent pads 30 may be removably secured to the arm pit area in each sleeve opening 26 in the main body 20 of the undershirt 18, if desired in the manufacture thereof. It shall also be noted that some of the sanitary hygienic pads 56 may be secured into the panties 48, if desired in the manufacture thereof.

As seen in FIG. 4, elastic bands 14 and magnetic fasteners 16 are fixedly secured to opposite mating edges of the undershirts, underpants and panties in all embodiments so that when the user dons both a shirt and pants the mating seams may be secured together adjustably as one unit.

While certain novel features of this invention have been shown and descried and are pointed out in the annexed claims, it will be understood that various omissions, substitutions and changes in the forms and details of the device illustrated and in its operation can be made by those skilled in the art without departing from the spirit of the invention.

What is claimed is:

1. Traveling and disposable underwear comprising;

a) an undergarment fabricated out of soft absorbent material and having a side seam opening;

b) elastic bands secured to said undergarment, allowing the undergarment to adjustably fit a wearer;

c) magnetic fasteners secured to said side seam opening in said undergarment for closure of said side seam opening thereby enabling the wearer to easily don and doff said undergarment;

d) magnetic fasteners secured to a waist seam opening in said undergarment for securing said garment to another garment which has been similarly provided; and e) an elastic band secured to said waist seam opening allowing the garment to adjustably fit the waist region of the wearer, wherein the elastic band at the waist seam opening and the magnetic fasteners secured to the waist seam opening comprise a single unit for adjustably securing the garment to a likewise provisioned garment.

2. Traveling and disposable underwear as recited in claim 1, wherein said undergarment is an undershirt and includes;

a) a main body having a waist opening, a neck opening and a pair of sleeve openings;

b) a pair of sleeves, each fixedly secured about one said sleeve opening in said main body for receiving one arm of the wearer;

c) each said elastic band is fixedly secured about the bottom of each sleeve, about the top of each said sleeve at said sleeve opening in said main body and about said waist opening in said main body;

d) a pair of absorbent pads, each fixedly secured in an arm pit area of one said sleeve opening in said main body for absorbing underarm perspiration of the wearer; and e) said magnetic fasteners are fixedly secured to opposite edges of said side seam opening at said waist opening in said main body so that after the wearer dons said undershirt, said magnetic fasteners will provide adjustable closure of said side seam opening.

3. Traveling and disposable underwear as recited in claim 1, wherein said undergarment is an undershirt and includes;

a) a main body having a waist opening, a neck opening and a pair of sleeve openings;

b) a pair of sleeves, each fixedly secured about one said sleeve opening in said main body for receiving one arm of the wearer;

c) each said elastic band is fixedly secured about the bottom of each said sleeve, about the top of each said sleeve at said sleeve opening in said main body and about said waist opening in said main body;

d) a pair of absorbent pads, each removably secured with said magnetic fasteners in an arm pit area of one said sleeve opening in said main body for absorbing underarm perspiration of the wearer; and e) said magnetic fasteners are fixedly secured to opposite edges of said side seam opening at said waist opening in said main body so that after the wearer dons said undershirt, said magnetic fasteners will provide adjustable closure of said side seam opening.

4. Traveling and disposable underwear as recited in claim 2, wherein said undershirt further includes;

a) said main body having a pair of breast openings;

b) a pair of nursing pads to cover said breast openings in said main body; and c) said magnetic fasteners are fixedly secured about said breast openings and about said nursing pads so that said nursing pads are removably secured over said breast openings in said main body.

5. Traveling and disposable underwear as recited in claim 1, wherein said undergarment is a pair of men's underpants and includes;

a) a main body having a waist opening and a pair of legs;

b) each said elastic band is fixedly secured about the bottom of one said leg, about one said leg below a crotch portion of said main body and about said waist opening in said main body;

c) a first set of said magnetic fasteners are fixedly secured to opposite edges of said side seam opening at said waist opening in said main body so that after said underpants are pulled upon the wearer said first set of said magnetic fasteners will provide adjustable closure of said side seam openings; and d) a second set of said magnetic fasteners are fixedly secured about a fly-opening and about a fly-flap of said main body so that said second set of said magnetic fasteners will provide closure for said fly-flap when pressed closed.

6. Traveling and disposable underwear as recited in claim 1, wherein said undergarment is a pair of women's panties and includes;

a) a main body having a waist opening and a pair of leg openings;

b) each said elastic band is fixedly secured about one leg opening, about an intermediate portion of said main body that engages with a hip portion of the wearer and about said waist opening in said main body; and c) said magnetic fasteners are fixedly secured to opposite edges of said side seam opening at said waist opening in said main body so that after said panties are pulled upon the wearer, said magnetic fasteners will provide adjustable closure of said side seam opening.

7. Traveling and disposable underwear as recited in claim 4, wherein said panties further includes:

a) a sanitary hygienic pad for a crotch area of said main body; and b) said magnetic fasteners are fixedly secured about the crotch area of said main body and about said sanitary hygienic pad so that said sanitary hygienic pad is removably secured to the crotch area of said main body.

* * * * *